US007950829B2

(12) United States Patent
Chiu et al.

(10) Patent No.: US 7,950,829 B2
(45) Date of Patent: May 31, 2011

(54) HIGH EFFICIENCY LIGHT EMITTING DIODE APPARATUS

(75) Inventors: Shao-Chen Chiu, Taichung County (TW); Yih-Hua Renn, Taichung County (TW); Ray-Long Tsai, Taichung County (TW); Shih-Tsung Chang, Taichung County (TW); Chi-Feng Cheng, Taichung County (TW)

(73) Assignee: Taiwan Green Point Enterprises Co., Ltd., Taichung County (TW)

( * ) Notice: Subject to any disclaimer, the term of this patent is extended or adjusted under 35 U.S.C. 154(b) by 243 days.

(21) Appl. No.: 12/421,114

(22) Filed: Apr. 9, 2009

(65) Prior Publication Data

US 2010/0214781 A1 Aug. 26, 2010

(30) Foreign Application Priority Data

Feb. 23, 2009 (TW) ..... 98105583 A

(51) Int. Cl.
*F21V 29/00* (2006.01)

(52) U.S. Cl. ..... 362/294; 362/249.02

(58) Field of Classification Search ..... 362/249.02, 362/294, 249.06, 373
See application file for complete search history.

(56) References Cited

U.S. PATENT DOCUMENTS

2010/0014289 A1* 1/2010 Thomas et al. ..... 362/294
* cited by examiner

*Primary Examiner* — David V Bruce
(74) *Attorney, Agent, or Firm* — Rosenberg, Klein & Lee

(57) ABSTRACT

The high efficiency light emitting diode apparatus mainly comprises a connector, a heat dissipating body, a light generator, a central venting portion, and a transparent casing. This connector has a flow guider, a flow chamber and a vent. The light generator contains several LEDs. The heat dissipating body includes an inner passage and an outer passage. The central venting portion has a central channel. An inner flow path and an outer flow path are formed. So, the heat dissipating effect of the flow paths is excellent. The structure forming two flow paths can enhance the heat dissipating effect. The auxiliary element can strengthen the overall illuminating effect. Plus, the auxiliary element can make the light more uniformly.

10 Claims, 10 Drawing Sheets

HIGH EFFICIENCY LIGHT EMITTING DIODE APPARATUS

BACKGROUND OF THE INVENTION

1. Field of the Invention

The present invention relates to a high efficiency light emitting diode apparatus. It includes an inner flow path and an outer flow path. The heat dissipating effect of the flow paths is excellent. The structure forming two flow paths can enhance the heat dissipating effect. The auxiliary element can strengthen the overall illuminating effect. Plus, the auxiliary element can make the light more uniformly.

2. Description of the Prior Art

Referring to FIG. 11, it shows a first traditional light emitting diode illuminating device. It contains many light emitting diodes (or briefly referred as LEDs) 81 disposed around so as to form an illuminating device 80.

As shown in FIG. 12, it exhibits a second traditional light emitting diodes 91 disposed on a seat 92 that forms another illuminating device 90.

When the LEDs are working, they remain at a working temperature. If it is overheated, the brightness of the LEDs decreases or even burns out. Under such circumstance, how to control the working temperature becomes a major issue.

However, the traditional devices still have the following problems.

[a] The overall heat dissipating effect is poor. The LEDs in the first traditional one generate heat that will accumulate in the central portion of that device. The heat continues to be accumulated. Then, its temperature rises quickly. Because the heat dissipation is poor, it causes the brightness gradually decreases or even dies out. In addition, although the LEDs in the second traditional one seem evenly distributed on the seat, it will not form any flows to swiftly bring out the heat. Therefore, the heat dissipating effect is poor. Also, the product life is relatively shorter.

[2] The illuminating effect is limited. These two traditional ones only utilize the LEDs as the lighting source. There is no any auxiliary element to enhance the overall illuminating effect. Thus, the illuminating effect is limited. If the user increases the amount of LEDs, it does increase the brightness. However, it also generates other serious problems such as poor heat dissipation, big power consumption, etc.

So, it is hard to find a best point that is well balanced among the amount of the LEDs, the brightness issue, and the heat dissipating effect.

SUMMARY OF THE INVENTION

The objects of the present invention are to provide a high efficiency light emitting diode apparatus. In which, the heat dissipating effect of the flow paths is excellent. The structure forming two flow paths can enhance the heat dissipating effect. The auxiliary element can strengthen the overall illuminating effect. Plus, the auxiliary element can make the light more uniformly. Moreover, this invention can solve the problems about the brightness decreases, the overall heat dissipating effect is poor, and the illuminating effect is limited. Besides, it can find a best point that is well balanced among the amount of the LEDs, the brightness issue, and the heat dissipating effect.

In order to solve the problems of the traditional ones, this invention is provided. A high efficiency light emitting diode apparatus comprising:

a connector having an electric connecting portion, an electrical processor, a flow guider and a connecting housing, said electrical processor being connected with said electric connector, said flow guider being disposed at an end opposite to said electric processor, said connecting housing being disposed on an outer edge of said electrical processor; said connecting housing having an inner side that forms an air guiding chamber, and said connecting housing having at least one vent;

a heat dissipating body disposed on one end of said connector, said heat dissipating body having a working surface, an inner passage and at least one outer passage, said inner passage being internally formed in said heat dissipating body, said at least one outer passage being distributed around said inner passage;

a light generator containing several light emitting diodes distributed as a ring-shaped arrangement, said light generator being secured on said working surface, said light generator being powered by said electrical processor;

a central venting portion disposed on an open end of said heat dissipating body, said central venting portion having a first end, a second end, and at least one central channel, said first end being mounted on said heat dissipating body, said central channel communicating with said inner passage so as to form a through hole; and a transparent casing having a securing flange, a storage space, and an air hole, said securing flange being connected with one end of said heat dissipating body, said storage space having a hollow interior, said air hole penetrating through said transparent casing, said storage space allowing said central venting portion being positioned therein;

wherein an inner flow path and several outer flow paths are formed between said vent and said air hole, said inner flow path being consisted of said air hole, said central channel, said inner passage, said flow guider, and said vent; said outer flow path being consisted of said air hole, said storage space, said outer passage, said flow chamber, and said vent.

DETAILED DESCRIPTION OF THE PREFERRED EMBODIMENT

Figure 1:
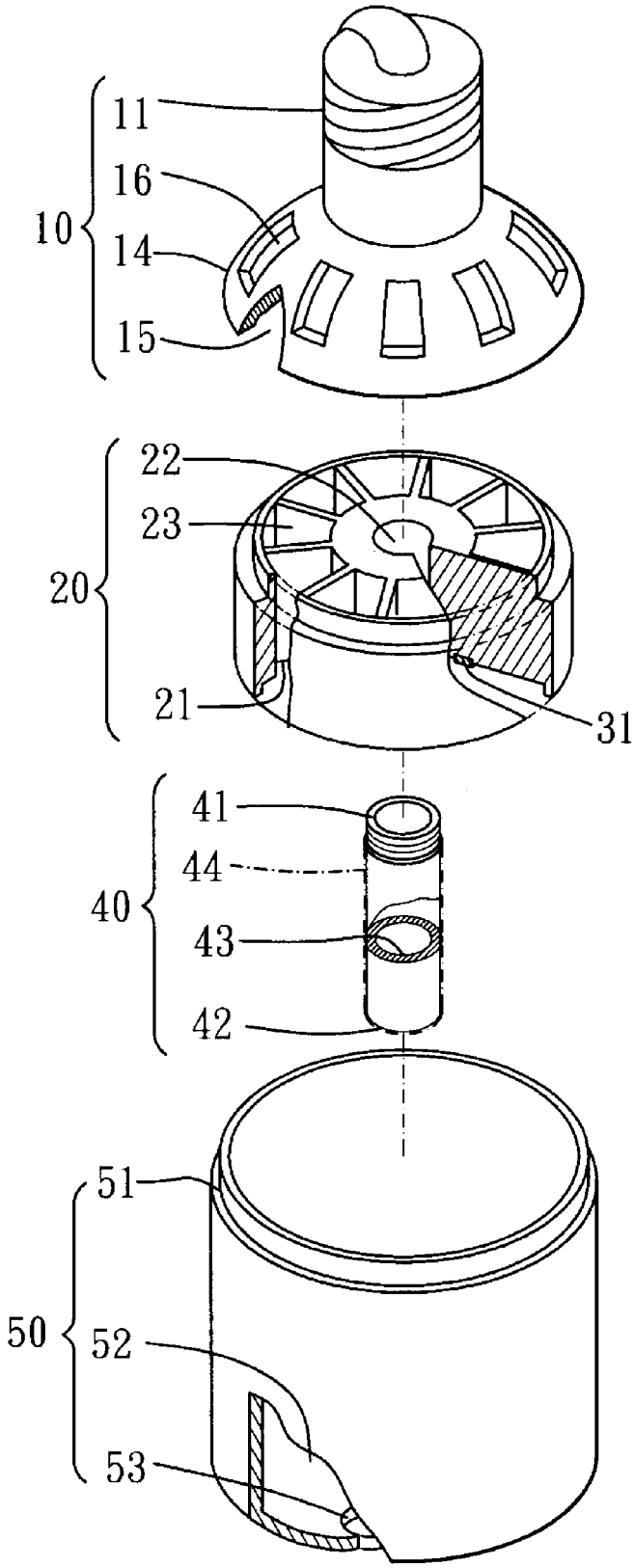
FIG. 1 is a perspective view of the present invention.
Figure 2:
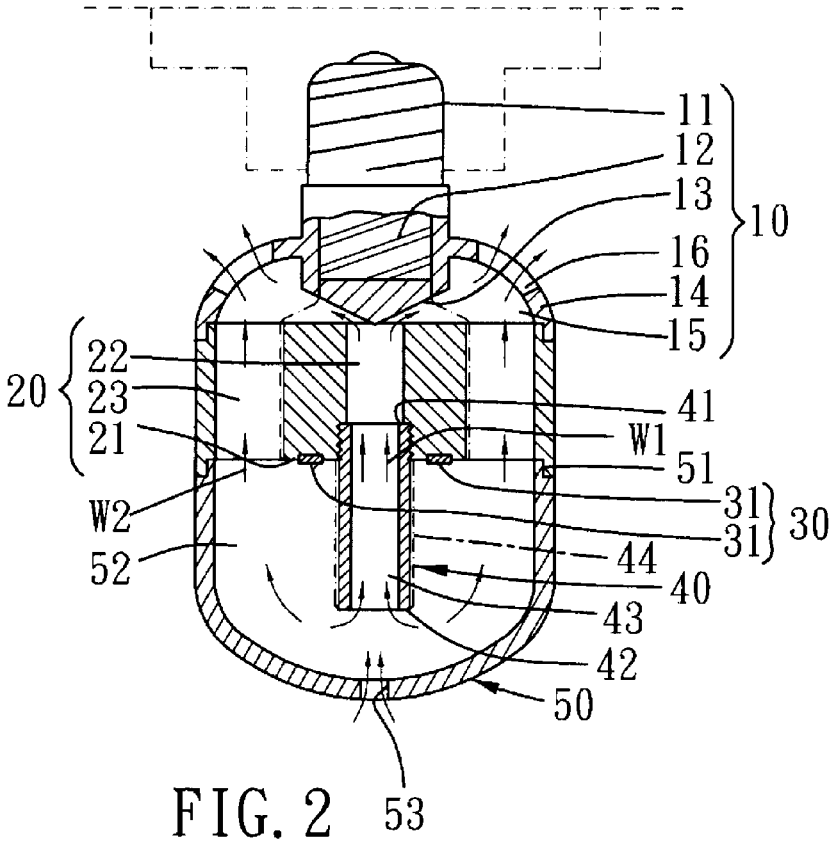
FIG. 2 is a cross-sectional view of the present invention.

FIGS. 1 and 2 show the first preferred embodiment of the present invention. This invention is a high efficiency light emitting diode apparatus. It mainly comprises a connector 10, a heat dissipating body 20, a light generator 30, a central venting portion 40, and a transparent casing 50.

Concerning this connector 10, it has an electric connecting portion 11, an electrical processor 12, a flow guider 13 and a connecting housing 14. The electrical processor 12 is connected with the electric connector 11. The flow guider 13 is disposed at an end opposite to the electric processor 12. The connecting housing 14 is disposed on an outer edge of this electrical processor 12. Further, the connecting housing 14 has an inner side that forms an air guiding chamber 15. In addition, the connecting housing 14 has at least one vent 16.

Figure 3:
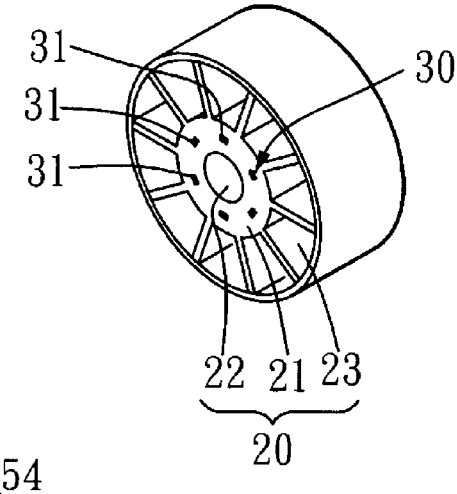
FIG. 3 is an enlarged view of the heat dissipating body of this invention.

The heat dissipating body 20 (as shown in FIG. 3) is disposed on one end of the connector 10. The heat dissipating body 20 has a working surface 21 (that is at one side of the heat dissipating body 20), an inner passage 22, and at least one outer passage 23. This inner passage 22 is internally formed in the heat dissipating body 20. The outer passages 23 are distributed around the inner passage 22.

With regard to the light generator 30, it contains several light emitting diodes (LED) 31 distributed as a ring-shaped arrangement. The light generator 30 is secured on the working surface 21 (as exhibited in FIG. 3). This light generator 30 is powered by the electrical processor 12.

About this central venting portion 40, it is disposed on an open end of the heat dissipating body 20. The central venting portion 40 has a first end 41, a second end 42, and at least one central channel 43. Moreover, the first end 41 is mounted on the heat dissipating body 20. The central channel 43 communicates with the inner passage 22 so that a through hole is formed.

Concerning the transparent casing 50 (see FIG. 4), it has a securing flange 51, a storage space 52, and an air hole 53. The securing flange 51 is connected with one end of the heat dissipating body 20. The storage space 52 has a hollow interior. Further, the air hole 53 penetrates through the transparent casing 50. The storage space 52 is provided for allowing the central venting portion 40 can be positioned therein.

Therefore, an inner flow path W1 and several outer flow paths W2 are formed between the vent 16 and the air hole 53. The inner flow path W1 is consisted of the air hole 53, the central channel 43, said inner passage 22, the flow guider 13, and said vent 16. The outer flow path W2 is consisted of the air hole 53, the storage space 52, the outer passages 23, the flow chamber 15, and the vent 16.

Figure 5A:
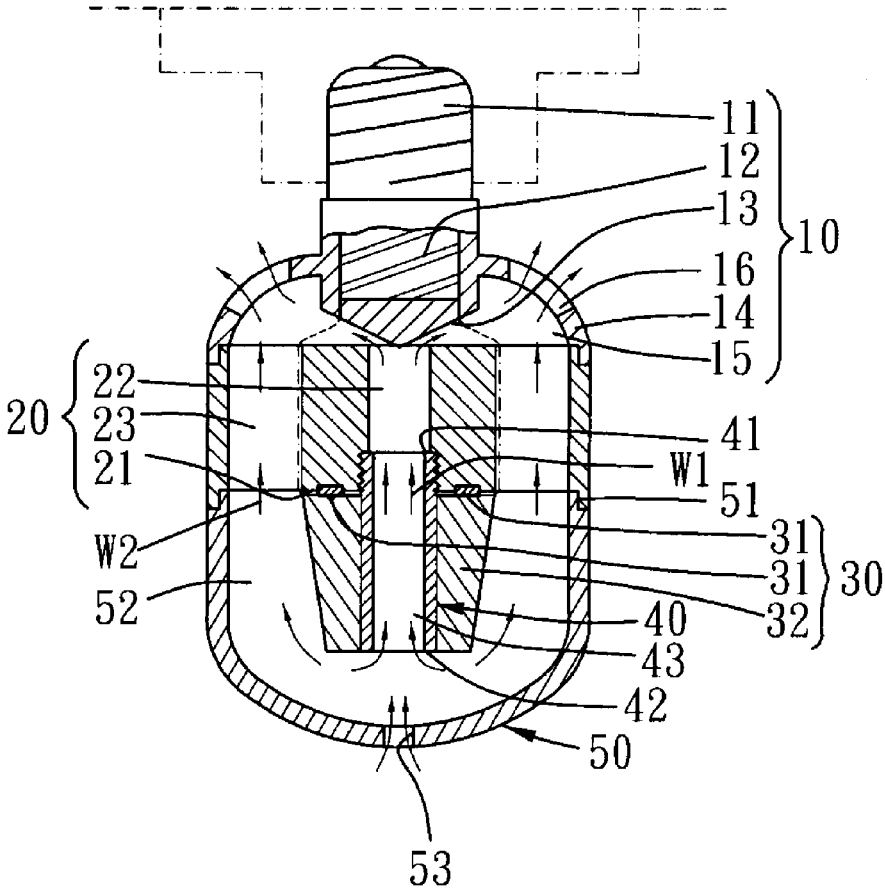
FIG. 5A is a view illustrating the first installation method with a light guiding element of this invention.
Figure 6A:
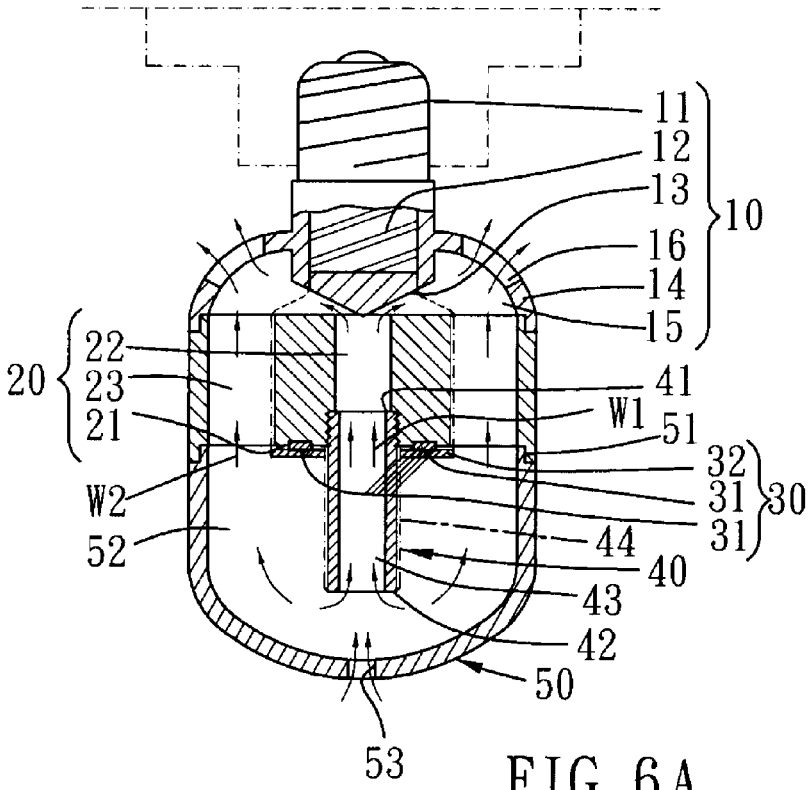
FIG. 6A is a view illustrating the first installation method with a light diffuser of this invention, FIG. 6B an enlarged view in FIG. 6A showing the first preferred embodiment of the light diffuser in this invention.
Figure 8A:
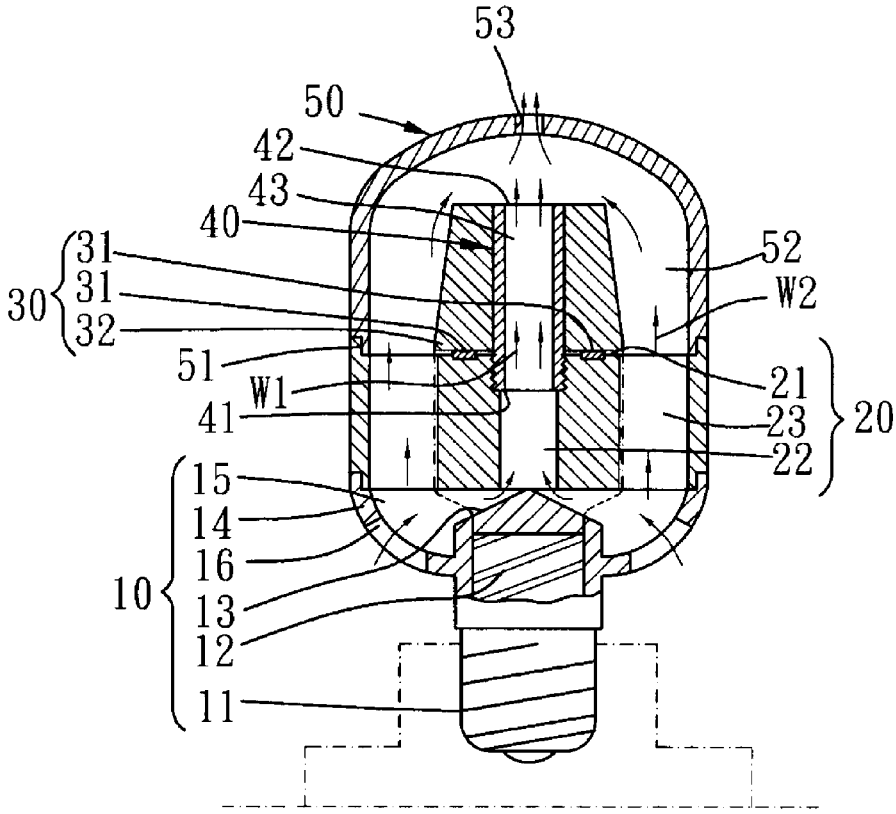
FIG. 8A is a view illustrating the second installation method with a light guiding element in this invention.
Figure 9A:
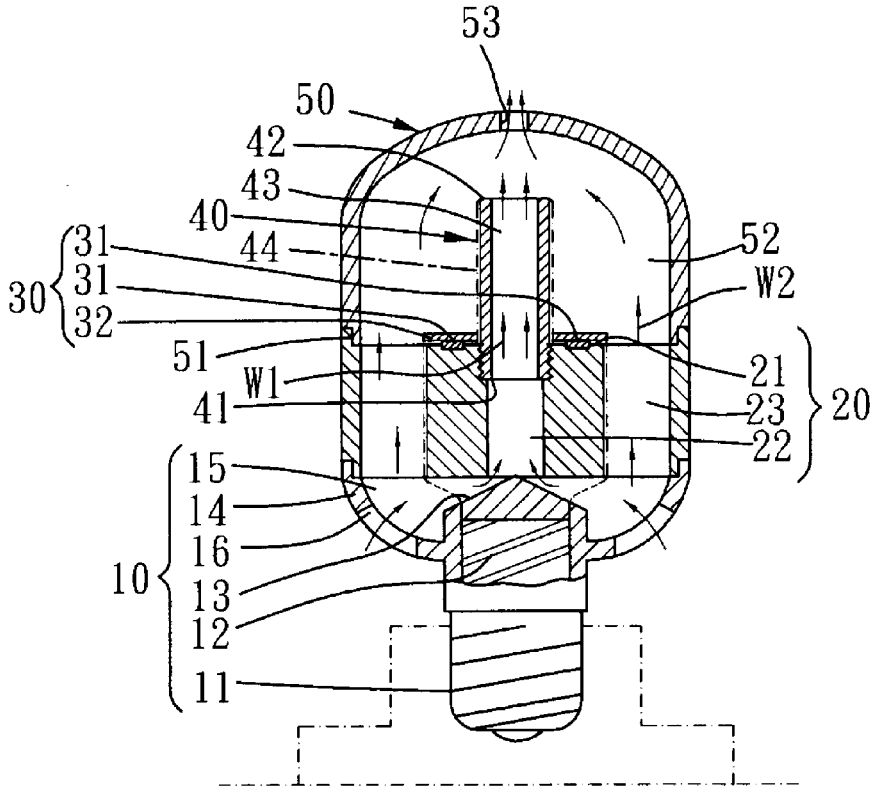
FIG. 9A is a view illustrating the second installation method with a light diffuser in this invention.

Practically, the flow guider 13 could be conical (as shown in FIGS. 5A and 8A) or flat (as shown in FIGS. 6A and 9A). When the flow guider 13 is a flat structure, it can further include a non-electricity-driven fan 131 (as shown in FIG. 6A). The fan 131 can be driven by natural convection without any power.

Figure 10:
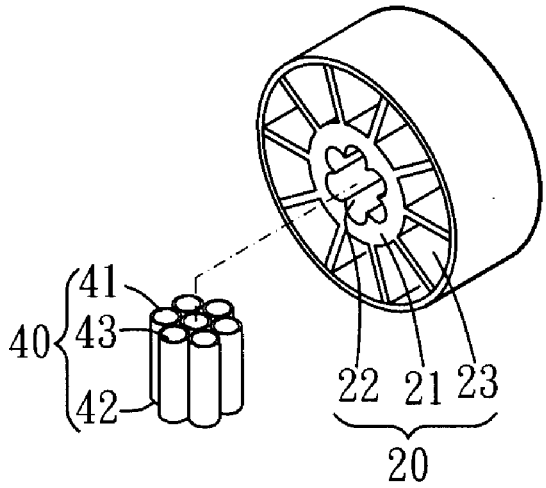
FIG. 10 is a perspective view of another embodiment of the central venting portion to be disposed in the inner passage of the heat dissipating body in this invention.
Figure 11:
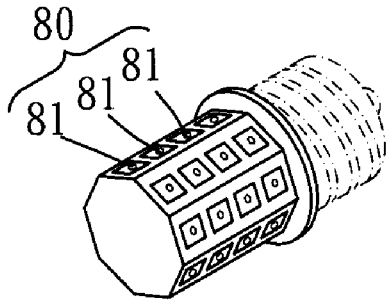
FIG. 11 PRIOR ART
FIG. 11 is a perspective view of the first traditional light emitting diode illuminating device.
Figure 12:
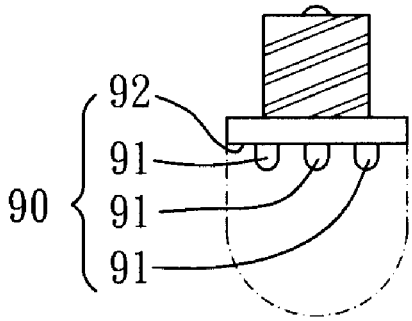
FIG. 12 PRIOR ART
FIG. 12 is a perspective view of the second traditional light emitting diode illuminating device.

In addition, the inner passage 22 can be a circular passage or a polygonal passage (as shown in FIG. 10). Of course, one or more central venting portions 40 can be installed in this inner passage 22.

In order to enhance the illuminating effect, the light generator 30 can further include a light guiding element 32 or a light diffuser 33. Or, it can include both.

Figure 5B:
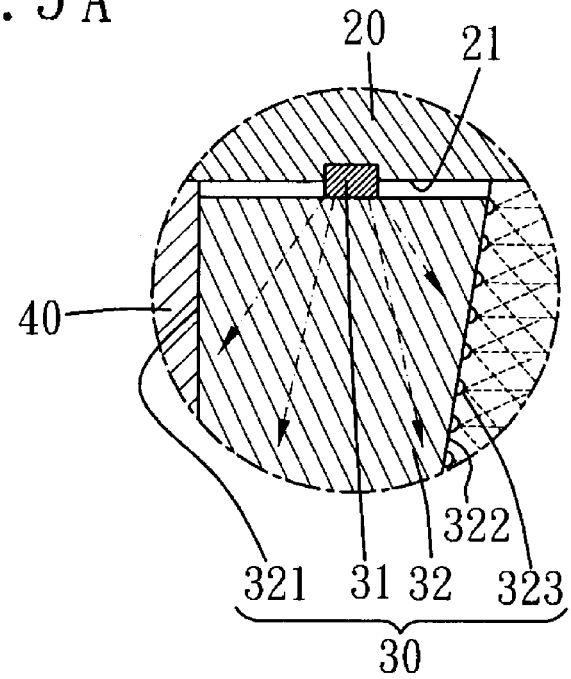
FIG. 5B is an enlarged view in FIG. 5A showing the first preferred embodiment of the light guiding element in this invention.
Figure 5C:
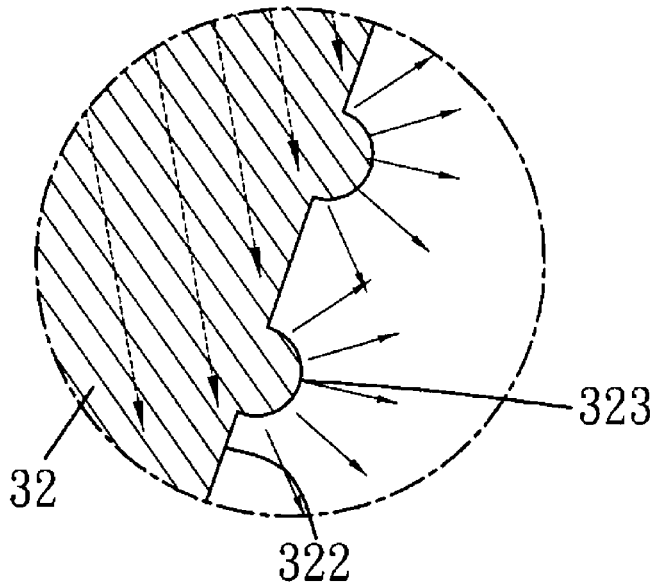
FIG. 5C is an enlarged view of a selected portion in FIG. 5B.
Figure 5D:
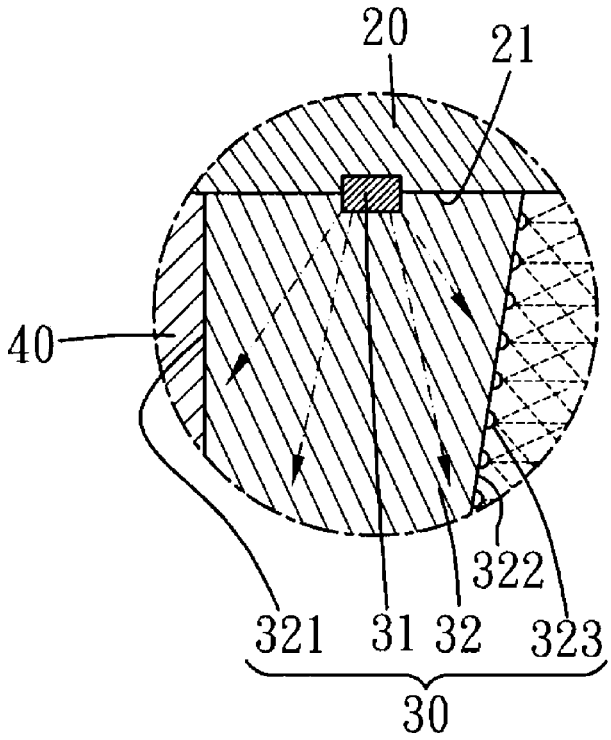
FIG. 5D is an enlarged view in FIG. 5A showing the second preferred embodiment of the light guiding element in this invention.
Figure 8B:
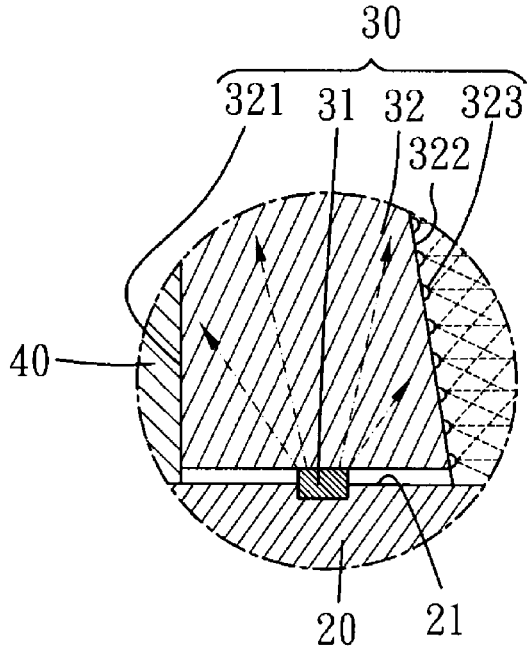
FIG. 8B is an enlarged view showing the first example of the light guiding element in this invention.
Figure 8C:
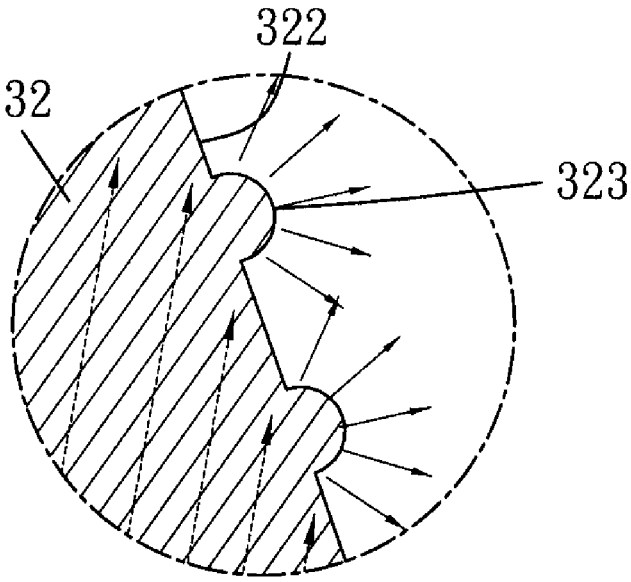
FIG. 8C is an enlarged view of a selected portion in FIG. 8B.
Figure 8D:
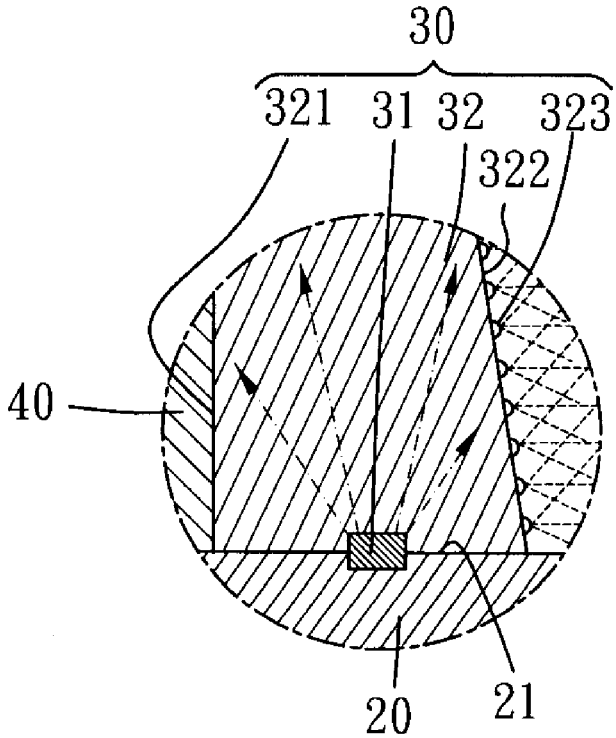
FIG. 8D is an enlarged view showing the second example of the light guiding element in this invention.

With regard to the light guiding element 32 (as shown in FIGS. 5A and 8A), it includes an inside surface 321 and an outside surface 322. The outer surface 322 is sloped with a preset tapered angle and is disposed with a plurality of optical microstructures 323 (as illustrated in FIGS. 5B, 5C, 8B and 8C). The light guiding element 32 may contact with the outer surface of the light emitting diodes 31 (as shown in FIGS. 5B & 8B) or may enclose the light emitting diodes 31 (as shown in FIGS. 5D & 8D). Because the light guiding element 32 contacts with the light emitting diodes 31, not only the light of the light emitting diodes 31 can be transmitted, but also the heat generated by the light emitting diodes 31 can be transferred so as to dissipate the heat of the light emitting diodes 31.

Figure 6B:
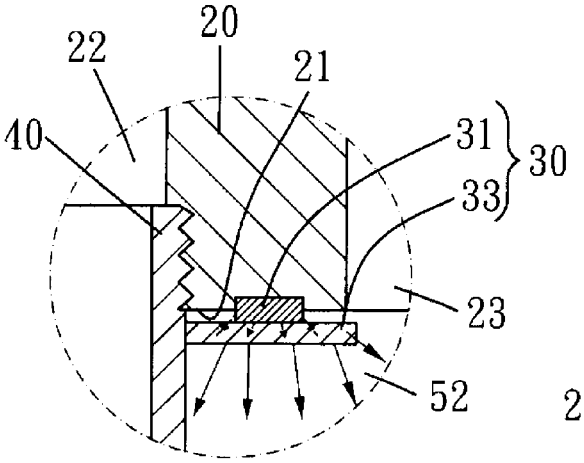
FIG. 6C an enlarged view in FIG. 6A showing the second preferred embodiment of the light diffuser in this invention.
Figure 6C:
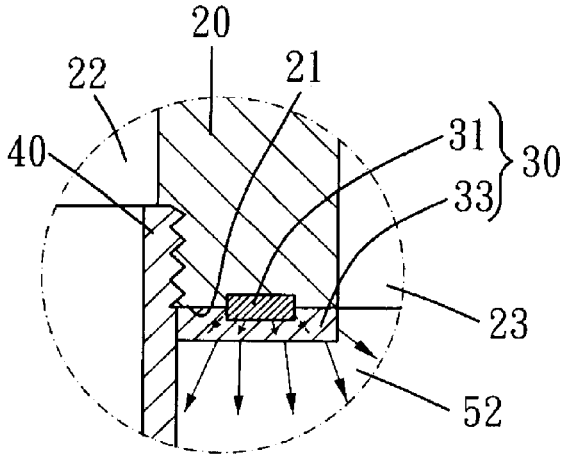
Figure 7:
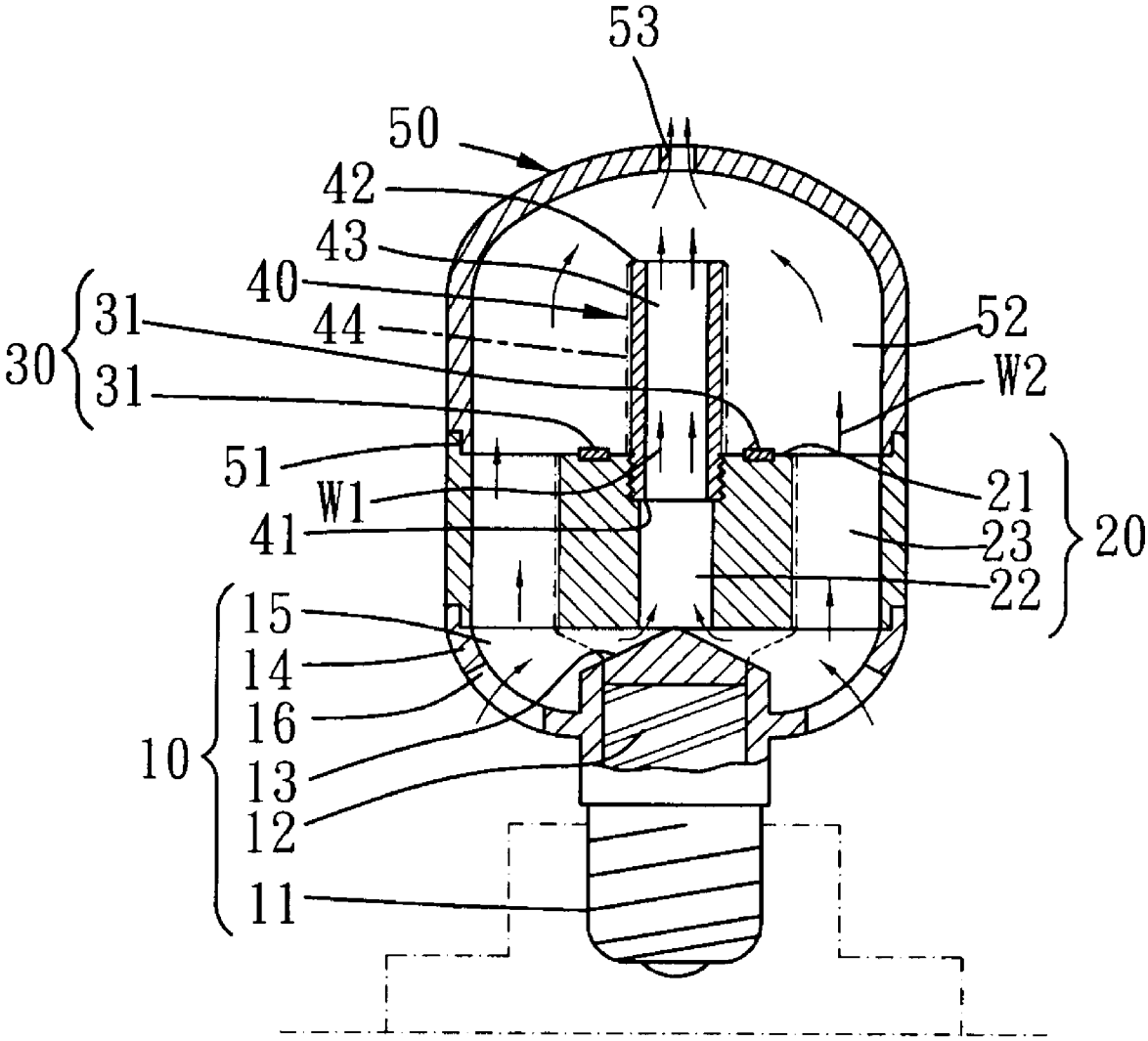
FIG. 7 is a view illustrating the second installation method of this invention.
Figure 9B:
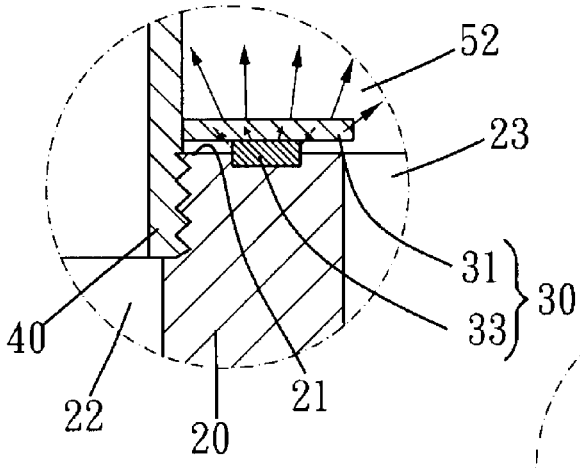
FIG. 9B is an enlarged view illustrating the first example of the light diffuser in this invention.
Figure 9C:
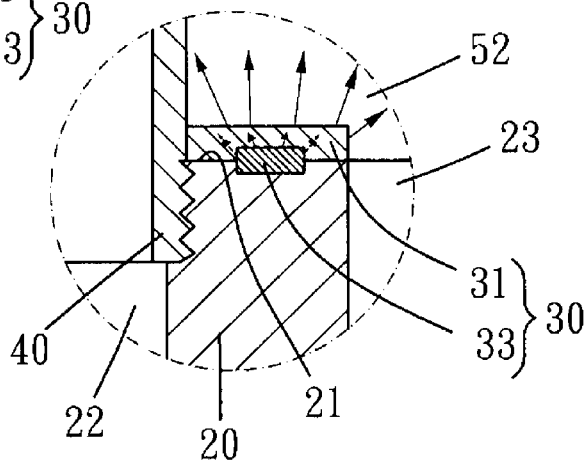
FIG. 9C is an enlarged view illustrating the second example of the light diffuser in this invention.

Next, the function of the light diffuser 33 is provided to diffuse the light uniformly (as shown in FIGS. 6A, 6B, 9A and 9B). The light diffuser 33 may contact with the outer surface of the light emitting diodes 31 (as shown in FIGS. 6B & 9B) or may enclose the light emitting diodes 31 (as shown in FIGS. 6C & 9C). Because the light diffuser 33 contacts with the light emitting diodes 31, not only the light of the light emitting diodes 31 can be transmitted, but also the heat generated by the light emitting diodes 31 can be transferred to the light diffuser 33 so as to dissipate the heat of the light emitting diodes 31.

The surface of the central venting portion 40 can further include a reflecting portion 44 so as to reflect light.

Figure 4:
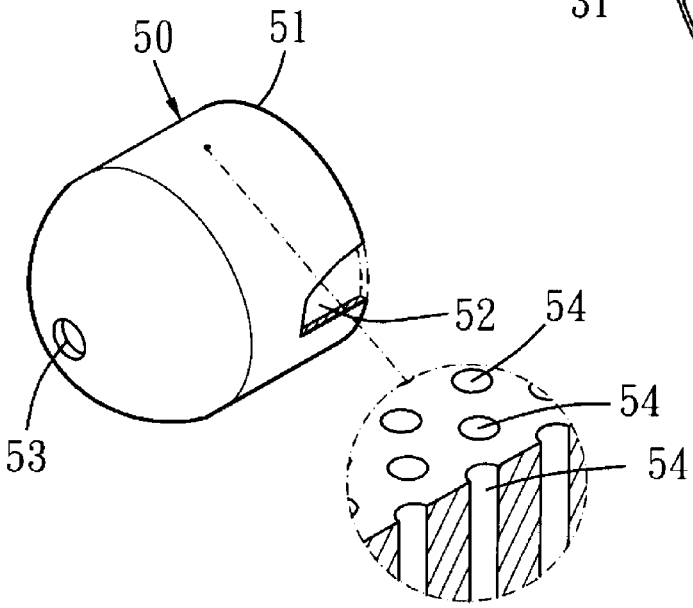
FIG. 4 is a view showing the transparent casing of this invention.

A plurality of optical microstructures may be added on the transparent casing 50 for having better illumination (more uniformly). Also, a plurality of micro holes (as illustrated in FIG. 4, the diameter of the micro hole is less than the wavelength of the light) can be formed on the transparent casing 50. Under this circumstance, when the light passing through these microstructures 54, a diffraction effect is occurred and the light emits more uniformly.

Moreover, about the installation method of this invention, the connector 10 can be faced upward and the transparent casing 50 is faced downward so that this invention can be installed on a predetermined position (see FIG. 2, such as on the ceiling), Or, it can be upside down (connector 10 facing downward and the transparent casing 50 facing upward, such as installing on the ground for illumination and guiding). Anyway, it can be installed at a tilted condition as well, if needed.

After turning on the light emitting diodes 31, the light emitting diodes 31 generate heat (at a relative high temperature). The heat dissipating body 20 behind the light emitting diodes 31 transmits a lot of heat away quickly. Meanwhile, the light guiding element 32 (or light diffuser 33) transmits certain heat away.

When the heat accumulates inside the transparent casing 50, its temperature is raised. The external cold air is sucked in via the air hole 53 (see FIG. 2). Two air streams are formed, namely, the inner flow path W1 (consisted of the air hole 53, the central channel 43, the inner passage 22, the flow guider 13, and said vent 16.) and several outer flow paths W2 (consisted of the air hole 53, the storage space 52, the outer passages 23, the flow chamber 15, and the vent 16). Thus, the heat can be removed by these air streams quickly so that the light emitting diodes 31 will not be overheated during a long-term use.

If this invention is installed upside down, the function remains unchanged. But, the flowing direction is just opposite to the previous one. The external cold air is sucked via the vent 16 (see FIG. 8A) so as to form two air streams, namely, the inner flow path W1 (consisted of the air hole 53, the central channel 43, said inner passage 22, the flow guider 13, and said vent 16.) and several outer flow paths W2 (consisted of the air hole 53, the storage space 52, the outer passages 23, the flow chamber 15, and the vent 16). Similarly, the heat can be expelled by these air streams quickly.

Therefore, the advantages and functions of the present invention can be summarized as follows.

[1] The heat dissipating effect of the flow paths is excellent. Except the heat dissipation of the heat dissipating body, the inner and outer flow paths bring a lot of heat away due to natural convection. The heat generated by the light emitting diodes will be taken way by the flowing air significantly. Thus, the heat dissipating effect is excellent.

[2] The structure forming two flow paths can enhance the heat dissipating effect. In this invention, it contains both the inner and outer flow paths. No matter this invention is installed at a regular position or upside down, the cold external air can enter the interior of this invention. The cooling air automatically separates into an inner one and an outer one due to the natural convection without any power. These two flow paths generate a good heat dissipating effect.

[3] The auxiliary element can strengthen the overall illuminating effect. By utilizing the light diffuser and/or the light guiding element, the light can be transmitted brighter. Hence, the illumination effect is strengthened.

[4] The auxiliary element can make the light more uniformly. Once the microstructure (such as the micro holes) is applied, the light will become more uniformly.

While this invention has been particularly shown and described with references to the preferred embodiments thereof, it will be understood by those skilled in the art that various changes or modifications can be made therein without departing from the scope of the invention by the appended claims.

What is claimed is:

1. A high efficiency light emitting diode apparatus comprising:

a connector having an electric connecting portion, an electrical processor, a flow guider and a connecting housing, said electrical processor being connected with said electric connector, said flow guider being disposed at an end opposite to said electric processor, said connecting housing being disposed on an outer edge of said electrical processor; said connecting housing having an inner side that forms an air guiding chamber, and said connecting housing having at least one vent;

a heat dissipating body disposed on one end of said connector, said heat dissipating body having a working surface, an inner passage and at least one outer passage, said inner passage being internally formed in said heat dissipating body, said at least one outer passage being distributed around said inner passage;

a light generator containing several light emitting diodes distributed as a ring-shaped arrangement, said light generator being secured on said working surface, said light generator being powered by said electrical processor;

a central venting portion disposed on an open end of said heat dissipating body, said central venting portion having a first end, a second end, and at least one central channel, said first end being mounted on said heat dissipating body, said central channel communicating with said inner passage so as to form a through hole; and a transparent casing having a securing flange, a storage space, and an air hole, said securing flange being connected with one end of said heat dissipating body, said storage space having a hollow interior, said air hole penetrating through said transparent casing, said storage space allowing said central venting portion being positioned therein;

wherein an inner flow path and several outer flow paths are formed between said vent and said air hole, said inner flow path being consisted of said air hole, said central channel, said inner passage, said flow guider, and said vent; said outer flow path being consisted of said air hole, said storage space, said outer passage, said flow chamber, and said vent.

2. The high efficiency light emitting diode apparatus of claim 1, wherein said flow guider is conical or flat.

3. The high efficiency light emitting diode apparatus of claim 2, wherein said flow guider further includes a non-electricity-driven fan.

4. The high efficiency light emitting diode apparatus of claim 1, wherein said inner passage is a circular passage or a polygonal passage.

5. The high efficiency light emitting diode apparatus of claim 4, wherein one or more central venting portions are installed in said inner passage.

6. The high efficiency light emitting diode apparatus of claim 1, wherein said light generator further comprises:

a light guiding element having an inside surface and an outside surface; said outer surface having a preset tapered angle and a plurality of optical microstructures.

7. The high efficiency light emitting diode apparatus of claim 1, wherein said light generator further comprises:

a light diffuser for diffusing the light uniformly.

8. The high efficiency light emitting diode apparatus of claim 1, wherein a surface of the central venting portion has a reflecting portion.

9. The high efficiency light emitting diode apparatus of claim 1, wherein the transparent casing comprises a plurality of optical microstructures or micro holes.

10. The high efficiency light emitting diode apparatus of claim 1, wherein said light guiding element contacts with or encloses the outer surface of the light emitting diodes.

* * * * *